United States Patent [19]

Francisco

[11] Patent Number: 4,950,386

[45] Date of Patent: Aug. 21, 1990

[54] ACIDIC PROMOTION OF TRANSITION METAL SULFIDE CATALYSTS FOR SELECTIVE HYDROGENATION

[75] Inventor: Manuel A. Francisco, Washington, N.J.

[73] Assignee: Exxon Research and Engineering Company, Florham Park, N.J.

[21] Appl. No.: 231,939

[22] Filed: Aug. 15, 1988

[51] Int. Cl.[5] ..... C10G 47/06; C10G 47/08; C10G 45/52

[52] U.S. Cl. ..... 208/108; 208/144; 208/215; 585/266; 585/268; 585/269; 585/277; 502/203; 502/216; 502/222; 502/223; 502/231

[58] Field of Search ..... 258/107, 108, 112, 111, 258/143, 144, 215; 585/250, 266, 268, 269, 273, 274, 275, 277; 302/203, 216, 222, 223, 231

[56] References Cited

U.S. PATENT DOCUMENTS

| | | | |
|---|---|---|---|
| 2,735,877 | 2/1956 | Mills et al. | 585/266 |
| 2,736,689 | 2/1956 | Stuart | 585/266 |
| 3,285,984 | 11/1966 | Goble | 585/268 |
| 3,344,200 | 9/1967 | Wald et al. | 585/268 |
| 3,409,684 | 11/1968 | Aristoff et al. | 208/144 |
| 3,623,973 | 11/1971 | Tarhan | 208/108 |
| 3,715,404 | 2/1973 | Lindlar et al. | 585/268 |
| 3,719,719 | 3/1973 | Amidon et al. | 258/143 |
| 3,784,481 | 1/1974 | Lassau et al. | 585/250 |
| 3,825,610 | 7/1974 | Sonoda et al. | 585/268 |
| 4,036,737 | 7/1977 | Wristers et al. | 208/108 |
| 4,036,738 | 7/1977 | Wristers | 208/111 |
| 4,097,541 | 6/1978 | Sakai et al. | 208/107 |
| 4,128,473 | 12/1978 | Karr, Jr. et al. | 208/215 |
| 4,224,458 | 9/1980 | Grey et al. | 585/266 |
| 4,313,017 | 1/1982 | McGinnis et al. | 585/268 |
| 4,664,777 | 5/1987 | Hudson et al. | 208/144 |
| 4,696,733 | 9/1987 | Tsao | 208/144 |
| 4,775,460 | 10/1988 | Reno | 208/112 |
| 4,783,565 | 11/1988 | Naruse et al. | 585/269 |

*Primary Examiner*—Anthony McFarlane
*Attorney, Agent, or Firm*—Joseph J. Dvorak

[57] ABSTRACT

It has now been discovered that hydrocarbon feeds containing a polycyclic aromatic compound or mixtures thereof can be selectively hydrogenated by contacting the feed with a transition metal catalyst and hydrogen in the presence of an acid to provide a hydrocarbon mixture in which the aromatic content consists substantially of mono- and di-aromatic compounds. Useful acids include Lewis acids and acids having a pKa in the range of 0 to about −10.

10 Claims, No Drawings

ACIDIC PROMOTION OF TRANSITION METAL SULFIDE CATALYSTS FOR SELECTIVE HYDROGENATION

FIELD OF THE INVENTION

This invention relates to a method of selectively hydrogenating polycyclic aromatic compounds and especially mixtures of polycyclic aromatic compounds such as those found in petroleum residues, coal liquids, and hydrocarbon feeds obtained from catalytic cracking and the like. More particularly, the present invention relates to the selective hydrogenation of polycyclic aromatic compounds including hydrocarbon feeds containing mixtures of condensed ring compounds with modified or promoted transition metal sulfide catalysts to obtain a hydrocarbon mixture in which the aromatic content consists substantially of mono- and di-aromatic compounds.

BACKGROUND OF THE INVENTION

The catalytic hydrogenation of polycyclic aromatic hydrocarbon feedstocks is well known. For example, in U.S. Pat. No. 3,012,963, there is disclosed a process for selectively converting polycyclic aromatics present in a lubricating oil to incompletely saturated hydrocarbons having one aromatic ring per molecule by hydrogenating the oil at temperatures in the range of 600° F. to about 800° F. in the presence of a nickel sulfide catalyst.

U.S. Pat. No. 3,719,719 discloses a process for selectively partially hydrogenating a polycyclic aromatic hydrocarbon by contacting the aromatic hydrocarbon with hydrogen in the presence of a catalyst consisting of platinum sulfide. Discrete polycyclic compounds and not mixtures thereof are employed as feeds.

U.S. Pat. No. 3,919,287 discloses the conversion of polycyclic aromatic compounds to cyclic olefins using a ruthenium-containing catalyst promoted with a transition metal dispersed in water or an aqueous acid.

U.S. Pat. No. 4,128,473 discloses hydrotreating carbonaceous liquids which contain aromatic compounds to obtain lower boiling liquids. The hydrogenation is described as being at temperatures in the range of 300° C. to 450° C. in the presence of nickel and other transition metals.

U.S. Pat. No. 4,244,808 discloses the use of a transition metal sulfide catalyst in hydrotreating a hydrocarbon fraction of a thermally cracked feedstock and thereafter removing the polyaromatics from the hydrotreated product.

Hydrocarbon feedstocks containing mixtures of polycyclic aromatic hydrocarbons, such as those that are obtained from petroleum residues, coal liquids and from thermal or catalytic cracking processes, typically contain sulfur and nitrogen compounds. These sulfur and nitrogen compounds must be removed or their concentration significantly lowered prior to hydrotreating the feedstock with noble metal catalysts since these compounds have a tendency to poison such catalysts. Transition metal sulfide catalysts, on the other hand, are are not poisoned by sulfur and nitrogen compounds and therefore are useful in hydrogenating such feedstocks. Unfortunately, hydrogenation with transition metal sulfide catalysts generally must be conducted above about 300° C. for reduction to be achieved, and, at these temperatures, there is no selectivity regarding the types of aromatic compounds that are reduced.

SUMMARY OF THE INVENTION

It has now been discovered that hydrocarbon feeds containing a polycyclic aromatic compound and mixtures thereof can be selectively hydrogenated by contacting the feed with a transition metal catalyst and hydrogen in the presence of an acid to provide a hydrocarbon mixture in which the aromatic content consists substantially of mono- and di-aromatic compounds. Useful acids include Lewis acids and acids having a pKa in the range of about 0 to about −10.

DETAILED DESCRIPTION OF THE INVENTION

The hydrocarbon feeds that may be treated in accordance with the practice of the invention include those feeds containing a polycyclic aromatic hydrocarbon or mixtures thereof, such as petroleum residues, coal liquids and hydrocarbon feeds obtained from catalytic cracking and the like, in which the polycyclic aromatic compound or mixtures thereof include compounds having more than two aromatic rings.

Basically, the hydrocarbon feed is contacted with hydrogen and a transition metal sulfide catalyst in the presence of acid selected from Lewis acids and acids having a pKa generally in the range of about 0 to about −10, and preferably in the range of from about −1 to about −5.

The metal sulfide catalysts that are suitable in the practice of the present invention are sulfides of transition metals of Groups VIb and VIII of the Periodic Table of the Elements as set forth in *Lang's Handbook of Chemistry,* 11th Edition, McGraw-Hill, Inc. (1973). Particularly preferred in the practice of the present invention is the use of noble metal sulfide catalysts, such as $PdS_2$, $Rh_2S_3$ and $Re_2S_7$.

As indicated, the hydrogenation, according to the present invention, is conducted in the presence of an acid selected from Lewis acids and acids having a pKa generally in the range of 0 to about −10. Preferred Lewis acids include the halides of boron and aluminum, such as $BF_3$, $BCl_3$, $AlCl_3$ and the like. Acids having pKa's that are suitable in the practice of the present invention include $CF_3CO_2H$, HCl, $H_2SO_4$, $BF_3.H_2O$, mixtures of $BF_3.H_2O$ with $CF_3CO_2H$ and the like. Especially effective results have been found with acids having a pKa in the range of from about −1 to about −5, such as, for example, trifluoroacetic acid which has a pKa of about −3.6.

The amount of acid employed relative to the amount of feedstock will generally be in the range of about 100:1 to about 10:1, and preferably in the range of 80:1 to about 40:1.

In general, the hydrogenation is conducted at temperatures below about 300° C,, and preferably in the range of about 100° C. to 200° C. and at hydrogen pressures in the range of about 100 psi to 2000 psi, and preferably 200 psi to 900 psi.

As should be readily appreciated, the contacting of the polycyclic aromatic hydrocarbon feed with the catalyst and hydrogen can be conducted in typical hydrogenation reactors normally employed for carrying out hydrogenations under the reaction conditions of temperature and pressure set out herein.

It should be noted that within the general parameters set forth above the hydrogenation activity in the process of the present invention tends to decrease with a decrease in the strength of the acid employed in the process. Additionally, the selectivity of the hydrogenation tends to increase with decreasing acid strength. On the other hand, the higher the temperature at which the hydrogenation is conducted, the greater the activity, i.e. the amount of aromatics converted, but the lower the selectivity. Consequently, the selection of appropriate hydrogenation temperature and particular acid to be used in a given hydrogenator will depend in part upon which parameter is particularly more important, greater activity or greater selectivity.

There are several important advantages in practicing the process of the present invention. The first of these is that hydrocarbon feeds containing polycyclic aromatic compounds having three or more aromatic rings and mixtures of such polycyclic aromatic compounds can be selectively hydrogenated so as to increase the amount of monoaromatic and di-aromatic compounds present in the mixture. Indeed, feeds containing mixtures of such polycyclic aromatic compounds can be hydrogenated in accordance with the practice of the present invention so as to produce a hydrocarbon mixture containing primarily mono- and di-aromatic compounds. Second, the hydrogenation reaction of the present invention can be conducted at low temperatures. Third, it has been discovered that sulfur and nitrogen compounds that are present in such feeds found suitable for the practice of the invention do not inhibit the selective hydrogenation of the polycyclic aromatic compounds present in the feed. Fourth, basic aromatic nitrogen heterocyclic compounds, if present in such a feed, will not be hydrogenated and thus do not inhibit the activity of the catalyst employed herein.

These and other features of the invention will become readily apparent from the foregoing disclosure especially when read in conjunction with the detailed example that follow.

EXAMPLES

Example 1

A 300 ml Hastelloy C autoclave was charged with the following ingredients: 0.135 grams naphthalene; 0.2723 grams 1-n-butylpyrene (BP); 0.2059 grams tetradecane (TD); 0.050 grams $Rh_2S_3$; 80.5 grams trifluorocetic acid (TFAA); 30 ml methylene chloride. Tetradecane was used as an internal standard for quantitative analysis by gas chromatography/mass spectroscopy. The BP, TD and naphthalene was dissolved in the methylene chloride and added to the TFAA in the autoclave. The catalyst was added to the autoclave and flushed several times with hydrogen gas and then pressurized with 857 psi of hydrogen. The autoclave was then sealed and heated at 100° C. for 24 hours with rapid stirring. After 24 hours, the autoclave was cooled, opened, and the reaction mixture was worked up by suction filtration to remove the catalyst. The filtrates were washed with distilled water until a neutral pH test was obtained. The filtrates were then dried over anhydrous sodium sulfate, suction filtered and concentrated to approximately 10 ml volume in vacuum and analyzed by gas chromatography/mass spectroscopy. The results found are set forth in Table I:

TABLE I

| Aromatic Compound | % Recovered | Hydrogenated Compounds | Products % |
|---|---|---|---|
| Naphthalene | 68 | Tetralin | 32 |
| Butylpyrene | 2 | Tetrahydrobutylpyrene | 66 |

TABLE I-continued

| Aromatic Compound | % Recovered | Hydrogenated Compounds | Products % |
|---|---|---|---|
| | | Dihydrobutylpyrene | 32 |

Example 2

The procedure set forth in Example 1 was followed except 0.050 g of $PdS_2$ was used instead of $Rh_2S_3$. The results are set forth in Table II:

TABLE II

| Aromatic Compound | % Recovered | Hydrogenated Compounds | Products % |
|---|---|---|---|
| Naphthalene | 95 | Tetralin | 5 |
| Butylpyrene | ND | Dihydrobutylpyrene | 51.6 |
| | | Tetrahydro + hexa-hydrobutylpyrenes | 27.9 |

ND = not determined.

Example 3

The general procedure of Example was followed except the aromatic compound used was anthracene (0.50 g), the acid used was aluminum chloride (0.50 g), the amount of methylene chloride used was 100 ml and heating was conducted for two hours. The results are set forth in Table III:

TABLE III

| Aromatic Compound | % Recovered | Hydrogenated Compounds | Products % |
|---|---|---|---|
| Anthracene | Trace | 9,10-dihydroanthracene | 80 |
| | | Octahydroanthracene | 15 |
| | | Perhydroanthracene | Trace |

Example 4

The procedure of Example 1 was followed using a mixture of naphthalene, pyrene and 1-n-butylpyrene and a hydrogen pressure of 215 psi.

TABLE IV

| Aromatic Compound | % Recovered | Hydrogenated Compounds | Products % |
|---|---|---|---|
| Naphthalene | 93.3 | Tetralin | 6.7 |
| Pyrene | 68 | Dihydropyrene | 31 |
| | | Tetrahydropyrene | 2 |
| Butylpyrene | 46 | Dihydrobutylpyrene | 41 |
| | | Tetrahydropyrene | 3 |
| | | Polyalkyl di- and tetra-hydropyrenes | 10 |

Example 5

In this example the procedure of Example 1 was followed except cyclohexane was used instead of methylene chloride. The results are set forth in Table V:

TABLE V

| Aromatic Compound | % Recovered | Hydrogenated Compounds | Products % |
|---|---|---|---|
| Naphthalene | 20 | Tetralin | 80 |
| Butylpyrene | 12 | Pyrene | 18 |
| | | Dihydropyrene | 2 |
| | | Dihydrobutylpyrene | 12 |
| | | Tetrahydrobutylpyrene | 18 |
| | | Tetrahydrodibutyl- | 20 |

TABLE V-continued

| Aromatic Compound | % Recovered | Hydrogenated Compounds | Products % |
|---|---|---|---|
| | | pyrene | |

Example 6

In this example the procedure of Example 1 was followed except a 2:1 mixture of trifluoroacetic acid and boron trifluoride monohydrate was used. The results are shown in Table VI:

TABLE VI

| Aromatic Compound | % Recovered | Hydrogenated Compounds | Products % |
|---|---|---|---|
| Naphthalene | 0 | Tetralin | 15 |
| | | Perhydronaphthalene | 22 |
| | | Butyltetralin | 63 |
| Butylpyrene | 66 | Dodecohydropyrene | 5 |
| | | Perhydropyrene | 1 |
| | | Tetrabutylpyrene | 28 |

Comparative Example 1

The procedure of Example 1 was followed except that 80 ml of methylene chloride was substituted for the trifluoroacetic acid. In this instance 99% of the naphthalene and butylpyrene were removed and less than 1% hydrogenated products were obtained.

Comparative Example 2

The procedure of Example 1 was followed except that metal sulfide catalyst was omitted with the result that 99% of the naphthalene and butylpyrene were recovered.

What is claimed is:

1. A process for selectively hydrogenating polycyclic aromatic compounds and mixtures thereof to obtain a hydrocarbon mixture containing increased amounts of mono-aromatic and di-aromatic compounds comprising:

contacting a polycyclic aromatic compound or mixtures thereof with hydrogen in the presence of a catalyst consisting essentially of a transition metal sulfide and an acid selected from the group consisting of Lewis acids and acids having a pKa in the range of about 0 to −10, the contacting being at a temperature of from about 100° C. to about 300° C. and at a pressure of about 100 psi to about 2000 psi for a time sufficient to selectively hydrogenate said compound or mixture whereby increased amounts of mono-aromatic and di-aromatic compounds are obtained.

2. The process of claim 1 wherein said transition metal sulfide catalyst is selected from Group VIb and Group VIII of the Period Table of the Elements.

3. The process of claim 2 wherein said transition metal sulfide catalyst is selected from the group consisting of $Rh_2S$, $PdS_2$ and $ReS_7$.

4. The process of claim 2 wherein said acid is an acid having a pKa of from about 0 to about −10.

5. The process of claim 4 wherein said acid has a pKa of from about −1 to about −5.

6. The process of claim 5 wherein said acid is trifluoroacetic acid.

7. The process of claim 5 wherein said acid is $BF_3.H_2O$.

8. The process of claim 2 wherein said acid is a Lewis acid.

9. The process of claim 8 wherein said Lewis acid is $AlCl_3$.

10. A process for selectively hydrogenating hydrocarbon feeds containing polycyclic aromatic compounds, at least some of which have at least three aromatic rings, to obtain a hydrocarbon mixture with increased mono- and di-aromatic hydrocarbon contents comprising:

contacting said feed with hydrogen in the presence of a catalyst consisting essentially of a transition metal of Group VIb and Group VIII metals and an acid selected from Lewis acids and acids having a pKa of from about 0 to about −10;

said contacting being at a temperature of from about 100° C. to about 300° C., at a hydrogen pressure of from about 100 psi to about 2000 psi and for a time sufficient to partially reduce at least a portion of polycyclic aromatic compounds in said feed having at least three aromatic rings whereby a hydrocarbon mixture having increased mono- and di-aromatic contents is obtained.

* * * * *